United States Patent [19]

Boyer

[11] Patent Number: 4,485,796

[45] Date of Patent: Dec. 4, 1984

[54] IGNITION DISTRIBUTOR VOLTAGE GENERATOR

[75] Inventor: James A. Boyer, Anderson, Ind.

[73] Assignee: General Motors Corporation, Detroit, Mich.

[21] Appl. No.: 518,670

[22] Filed: Jul. 29, 1983

[51] Int. Cl.[3] ..... F02P 5/00

[52] U.S. Cl. ..... 123/617; 310/70 R; 123/146.5 A; 200/19 M

[58] Field of Search ..... 123/617, 146.5 A; 200/19 M; 310/70 A, 70 R

[56] References Cited

U.S. PATENT DOCUMENTS

| | | | |
|---|---|---|---|
| 2,071,573 | 2/1937 | Randolph et al. . | |
| 2,918,913 | 12/1959 | Guiot . | |
| 3,034,018 | 5/1962 | Rosenberg . | |
| 3,060,346 | 10/1962 | Söhner . | |
| 3,198,973 | 8/1965 | Short et al. . | |
| 3,219,877 | 11/1965 | Konopa . | |
| 3,219,878 | 11/1965 | Konopa . | |
| 3,254,247 | 5/1966 | Falge . | |
| 3,375,812 | 4/1968 | Koda | 123/617 |
| 3,473,061 | 10/1969 | Soehner et al. . | |
| 3,651,793 | 3/1972 | Roth et al. . | |
| 3,888,225 | 6/1975 | Boyer et al. | 123/617 |
| 3,955,550 | 5/1976 | Carlsson | 310/70 R |
| 4,011,476 | 3/1977 | Beard | 310/70 R |
| 4,165,726 | 8/1979 | Helmer, Jr. | 123/617 |

FOREIGN PATENT DOCUMENTS

| | | | |
|---|---|---|---|
| 2830538 | 1/1980 | Fed. Rep. of Germany | 123/617 |

*Primary Examiner*—Parshotam S. Lall
*Attorney, Agent, or Firm*—C. R. Meland

[57] ABSTRACT

An ignition distributor for an internal combustion engine including a magnetic pick-up for generating a timing control voltage. The distributor has a rotor comprised of a plurality of radially extending circumferentially spaced permanent magnets that define rotor pole teeth. The permanent magnets are radially magnetized such that the outer tips all have the same magnetic polarity. As the rotor rotates, a voltage is induced in the pick-up coil by flux linking the coil that is provided by the permanent magnets. A combined electrostatic shield and flux shunt is provided that takes the form of a metallic plate of magnetic material that is located between one end of the pick-up coil and one end of the rotor.

8 Claims, 8 Drawing Figures

IGNITION DISTRIBUTOR VOLTAGE GENERATOR

This invention relates to a voltage pulse generator for providing a generated voltage the shape of which varies as a function of the rotary position of a rotatable shaft and, more particularly, to a voltage generator for controlling the timing of an internal combustion engine ignition system.

Voltage generating devices of the magnetic pick-up type for controlling an internal combustion engine electronic ignition system are known, examples being the devices disclosed in U.S. patents to Falge U.S. Pat. No. 3,254,247 and to Boyer U.S. Pat. No. 3,888,225. The voltage generators disclosed in these patents comprise an adjustable timing plate that carries an annular permanent magnet, a pick-up coil and a pole piece having radially extending teeth. The permanent magnet is axially magnetized to provide opposite magnetic polarities at opposite end faces thereof. A rotor which is formed of magnetic material is provided that is rotatably driven by a shaft and the rotor has radially extending teeth that become periodically aligned with the teeth of the pole piece as the rotor rotates.

The voltage pulse generator of this invention differs from those disclosed in the above-referenced patents in that, among other things, the rotor of the generator is comprised of a hub member formed of a magnetic material that carries a plurality of radially extending circumferentially spaced permanent magnets. The permanent magnets are radially magnetized and arranged such that the outer tip portions all have the same magnetic polarity, and the inner end faces of the permanent magnets that are carried by the hub member have an opposite magnetic polarity. The permanent magnets are generally wedge shaped and form pole teeth for the rotor. When the rotor rotates the outer tip portions of the permanent magnets become periodically aligned with pole teeth of a pole piece which forms part of a magnetic circuit for flux that links an annular pick-up coil. The permanent magnets are formed of a thermoplastic material that is filled with a magnetic material, such as barium ferrite.

It accordingly is an object of this invention to provide an improved voltage generator wherein the rotor of the generator is comprised of a hub member formed of magnetic material that carries a plurality of circumferentially spaced and radially extending permanent magnets that are radially magnetized and which are shaped to provide rotor pole teeth.

One of the advantages of this invention is that the air gaps between the rotor teeth and the pole piece do not have to be maintained at such a close tolerance, as compared to the devices disclosed in the above-referenced patents. The reason for this is believed to be due to the fact that the permanent magnets that form the rotor teeth have a permeability which is substantially the same as air (unity) and, as a result, unwanted flux fringing is reduced, as compared to the rotors of the above-referenced patents which are made of comparatively high permeability magnetic material.

Another object and feature of this invention is to provide an ignition distributor that has a voltage pulse generator of the type that has been described and that includes an electrostatic shield that also operates as a flux shunt. In carrying this object forward, a plate member that is formed of a metallic magnetic material is positioned so as to extend across the pick-up coil of the voltage generator. The plate member is electrically grounded and operates to prevent high frequency voltages developed in the distributor cap when an arc occurs between the conductive rotor segment and cap electrode, from being coupled to the pick-up coil.

Still another object of this invention is to provide an ignition distributor that has a voltage generating magnetic pick-up that is simplified in design and construction. Among the features that contribute to the attainment of this object is the manner in which the stationary parts are assembled to the base of the distributor. Thus, the pole piece, pick-up coil assembly and electrostatic shield are simply axially placed over a sleeve bearing carried by the distributor base. The coil form of the coil assembly has a post that is received in aligned holes formed respectively in the pole piece and distributor base and, after the parts have been axially assembled, a snap ring is applied to the sleeve bearing to secure the parts from axial movement. When this assembly is completed, a distributor shaft that carries the rotor that is comprised of the metallic hub and attached permanent magnets, is assembled to the distributor base.

IN THE DRAWINGS

Figure 1:
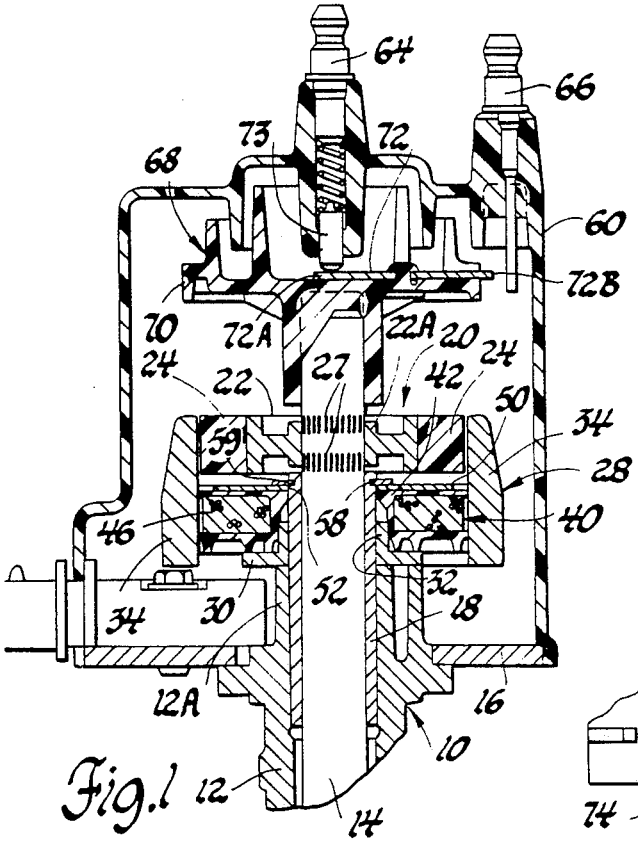
FIG. 1 is a sectional view of an ignition distributor made in accordance with this invention.
Figure 3:
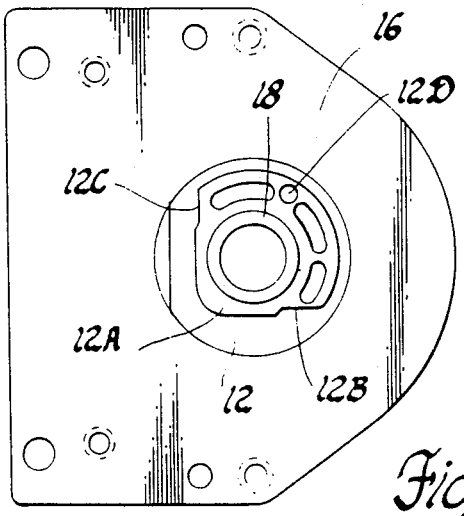
FIG. 3 is an end view of the base of the distributor illustrated in FIG. 1.

Referring now to the drawings and more particularly to FIG. 1, the reference numeral 10 generally designates a base assembly for an ignition distributor. The base assembly 10 has an axially extending part 12 provided with a bore for receiving a distributor shaft 14 which is formed of steel. The base 10 includes a laterally extending plate member 16 which is secured to the part 12. The part 12 and plate member 16 are formed of aluminum material, and plate member 16 is secured to the part 12 by a staking operation. The part 12 has an upwardly extending portion 12A, the end of which is illustrated in FIG. 3. The portion 12A has a pair of axially extending flat sidewalls 12B and 12C, the purpose of which will be more fully described hereinafter. In addition, the portion 12A of the part 12 has an axially extending bore or hole 12D. A tubular sleeve bearing 18 which is formed of a sintered iron and bronze composition for example, 60% iron and 40% bronze, is press fitted to the bore of part 12 and rotatably supports the upper end of the distributor shaft 14. The lower end of the shaft 14 is rotatably supported in another sleeve bearing (not shown) which is disposed in the bore of part 12 at a position adjacent the lower end thereof in a manner well known to those skilled in the art.

Figure 2:
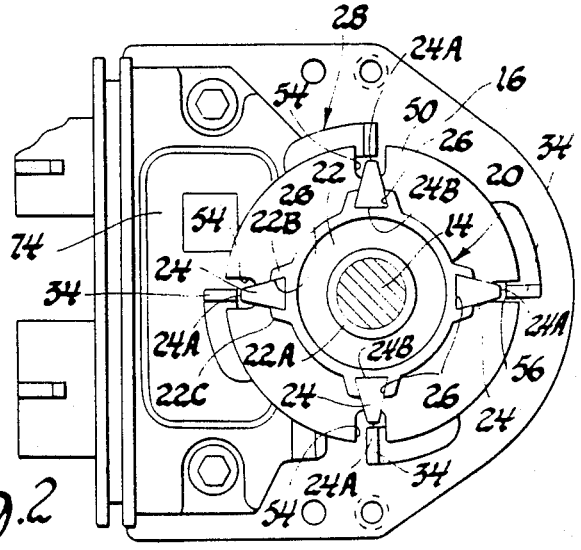
FIG. 2 is an end view of the distributor shown in FIG. 1, with the distributor cap removed.

The shaft 14 drives a magnetic rotor generally designated by the reference numeral 20. The rotor 20 comprises a metallic hub member 22 which carries four permanent magnets 24. The hub member 22 is formed of a magnetic material, such as sintered iron, and has an annular portion 22A engaging shaft 14 and also four wedge shaped, axially extending slots 26, best seen in FIG. 2. The permanent magnets 24 are also wedge shaped and the inner ends of these permanent magnets fit within the wedge shaped slots 26. The permanent magnets 24 are secured to the hub member 22 by a suitable adhesive compound. As an alternative, the permanent magnets 24 may be insert molded to the hub 22. Another method of securing the magnets 24 to the hub 22 is to fit the inner ends of the magnets in the slots 26 of the hub 22 and then crimp portions 22B and 22C of the hub 22 tightly against the inner end of each permanent magnet. The rotor 20 is secured to the shaft 14 by staking portions of the annular portion 22A of the hub member 22 into the splined areas 27 of the shaft 14.

The permanent magnets 24 are radially magnetized such that all of the outer tip portions 24A have the same magnetic polarity, and all of the inner faces 24B which engage the hub 22 have an opposite magnetic polarity. As an example, the permanent magnets 24 can be radially magnetized such that all of the outer tip portions 24A are north poles and all the inner faces 24B carried by the hub 22 are south poles. The permanent magnets 24 are preferably formed of a thermoplastic material which is filled with a magnetic material, such as barium ferrite. Each permanent magnet 24 may have an energy product of approximately $1.7\times10^6$ gauss-oersted.

Figure 4:
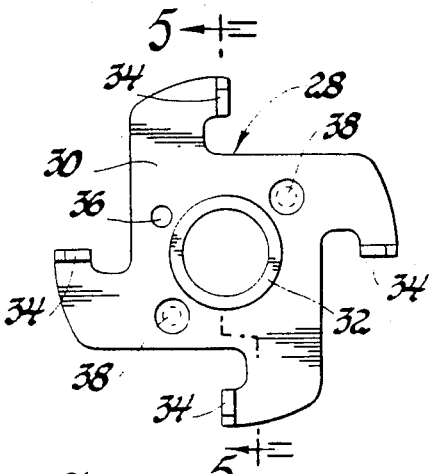
FIG. 4 is a plan view of a pole piece which forms a part of the distributor shown in FIG. 1.
Figure 5:
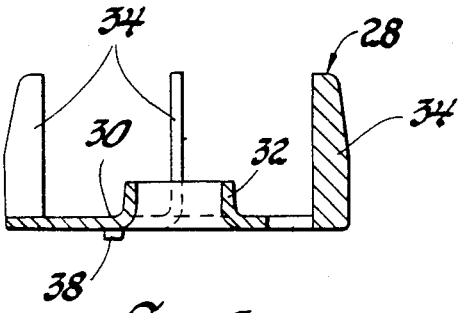
FIG. 5 is a sectional view taken along line 5—5 of FIG. 4.

The rotor 20 forms part of a voltage generator that includes a pole piece 28 formed of a magnetic material, such as steel, and which is shown in detail in FIGS. 4 and 5. The pole piece 28 has a laterally extending portion 30, an axially extending tubular portion 32, and a plurality of axially extending pole teeth 34. The ignition distributor shown in the drawings is for a 4-cylinder engine and the number of pole teeth 34 correspond to the number of permanent magnets 24, that is, there are four permanent magnets 24 and four pole teeth 34. The pole piece 28 has a hole 36 and has a pair of axially extending bosses 38 that are provided by forming portions of the steel material of the pole piece 28 to the shape illustrated. When the pole piece 28 is assembled, the tubular portion 32 is slipped over the sleeve bearing 18 and rotatably oriented such that the axially extending bosses 38 are positioned closely adjacent the walls 12B and 12C of the distributor base. With this orientation, the hole 36 in the pole piece 28 is aligned with the bore 12D formed in the distributor base and the lower wall of portion 32 engages the upper end of base portion 12A.

Figure 7:
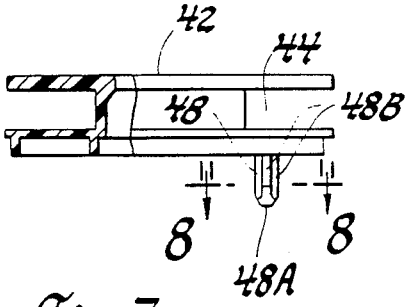
FIG. 7 is an end view, with parts broken away, of a spool that forms a part of the coil winding assembly of the ignition distributor shown in FIG. 1.
Figure 8:
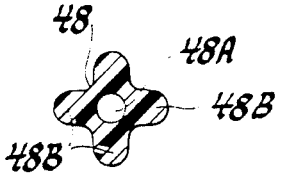
FIG. 8 is a sectional view taken along line 8—8 of FIG. 7.

The voltage generator further includes a coil winding assembly designated generally by the reference numeral 40. The coil winding assembly 40 comprises a spool 42 that is formed of insulating material and which is shown in detail in FIG. 7. As shown in FIG. 7, the spool 42 is configured to provide a space 44 that receives the coil winding 46. The coil winding 46 is wound in the space 44 and is concentric with the longitudinal axis of the spool 42. The spool 42 has an axially extending projection or post 48 that is integral with the spool. The projection or post 48 is tapered at its end 48A and, as shown in the sectional view of FIG. 8, is comprised of four ribs 48B.

When the coil winding assembly 40 is assembled to the base 10 of the distributor, and assuming that the pole piece 28 is in place, the coil winding assembly 40 is rotatably oriented so that post 48 can be projected through the hole 36 in the pole piece 28 and into the bore 12D formed in the base portion 12A. The diameter of the bore 12D and the width of the ribs 48B is such that the post 48 has a press fit with the bore 12D of the base 10.

Figure 6:
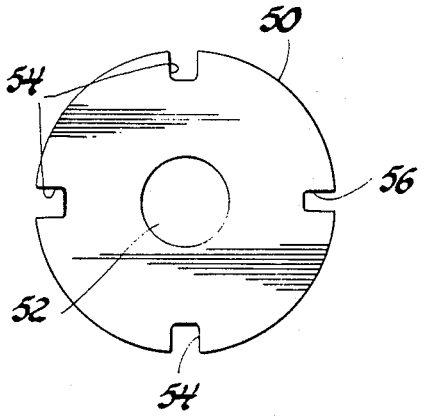
FIG. 6 is a view of a metallic shield which forms a part of the ignition distributor shown in FIG. 1.

The voltage generator of this invention further includes a metallic plate member 50 which is shown in detail in FIG. 6. The plate member 50 is formed of a magnetic material, such as steel, and its primary function is to serve as an electrostatic shield. The plate member 50 also operates as a flux shunting device in a manner to be more fully described hereinafter.

The plate member 50 has a central opening 52 and three radially extending slots 54. The slots 54 all have the same width, and the plate member 50 has another slot 56 which is not as wide as slots 54. By way of example, where the widths of the pole teeth 34 have a tolerance range of 2.0 to 2.18 millimeters, the slots 54 have a width of 4.60 to 5.20 millimeters, whereas the slot 56 has a tolerance range of approximately 2.85 to 3.15 millimeters. It can be seen from FIG. 1 that the plate member 50 extends laterally across one end of the pick-up coil assembly 40. When the plate 50 is assembled to the ignition distributor, the central opening 52 receives the upper portion of the sleeve bearing 18 and the notches or slots 54 and 56 respectively receive the pole teeth 34. In this regard, it is noted that the width of the narrower slot 56 will just receive one of the pole teeth 34 and therefore serves to properly orient the plate 50. In the final position of the plate 50, it can be seen that the inner edges of the wider slots 54 have a predetermined air gap with three of the pole teeth 34, the purpose of which will be more fully described hereinafter. One end of the plate 50 is engaged by a metallic snap ring 58 which fits within an annular groove 59 formed in the upper end of the sleeve bearing 18. The snap ring 58 is of a type that is slightly axially bowed to apply an axial force to plate 50, the pick-up coil assembly 40, and the pole piece 28.

The ignition distributor shown in FIG. 1 has a distributor cap designated by reference numeral 60. The cap 60 is formed of electrical insulating material and carries a center input electrode 64 and four circumferentially spaced output electrodes 66. The electrode 64 is adapted to be connected to the secondary winding of an ignition coil, while the electrodes 66 are adapted to be connected respectively to the spark plugs of an internal combustion engine. The electrode 64 and the electrodes 66 are periodically electrically connected by a distributor rotor generally designated by reference numeral 68. The rotor 68 comprises a part 70 formed of insulating material which carries a current conducting segment 72. The segment 72 has a portion 72A that engages a conductive spring biased brush 73 that is electrically connected to the electrode 64. The outer end 72B of segment 72 swings past lower portions of the output electrodes 66 in a manner well known to those skilled in the art to sequentially connect the secondary winding of the ignition coil to the spark plugs. The rotor 68 is connected to the top end of the distributor shaft 14 so as to be rotatably driven thereby, as illustrated in FIG. 1.

The voltage generator of this invention is intended to control an electronic ignition system for an internal combustion engine. The voltage induced in the pick-up coil 46 will be an alternating voltage and will have a shape generally similar to that shown in FIG. 7 of the above-referenced Boyer U.S. Pat. No. 3,888,225. The amplitude of the voltage is, of course, a function of the position of shaft 14 and when the shaft 14 is assembled to an engine and driven thereby, the voltage generated in the pick-up coil 46 will have an amplitude that is a function of the engine crankshaft position and hence this voltage can be used for ignition timing.

When the rotor 20 is rotatably driven by an engine, the permanent magnets 24 rotate with respect to the fixed pole teeth 34. The radially magnetized permanent magnets 24 will cause magnetic flux to traverse a path which is, for example: from the outer tip portions 24A of the magnets 24, through an air gap to pole teeth 34, through the axially extending pole teeth 34, through portions 30 and 32 of the pole piece 28 to the sleeve bearing 18 and steel distributor shaft 14, and then through the hub member 22 to the inner faces 24B of the permanent magnets 24. The width of the tip portions 24A of permanent magnets 24 is substantially equal to the width of the pole teeth 34. The maximum rate of change of flux will occur as the permanent magnets 24 approach and then pass by the pole teeth 34. Thus, as the permanent magnets 24 approach the pole teeth 34 (increasing flux), a voltage of one polarity will be induced in the pick-up coil 46, and as the permanent magnets 24 are moving away from the pole teeth 34 (decreasing flux), a voltage of an opposite polarity will be induced in the pick-up coil 46. When the tip portions 24A of the permanent magnets 24 are exactly aligned with the pole teeth 34, there is no substantial rate of change of flux with the result that the voltage induced in the pick-up coil 46 reduces substantially to zero. The voltage induced in the pick-up coil 46 does not depend on varying the reluctance of a magnetic circuit, but rather depends upon varying the flux in the magnetic circuit due to the varying rotatable positions of the permanent magnets 24.

The primary purpose of the plate 50, as has been previously mentioned, is to form an electrostatic shield. Thus, as rotor 68 rotates, the end 72B of segment 72 passes by the lower ends of the electrodes 66 and the energy stored in the secondary winding of the ignition coil is applied to the spark plugs via the gap between the end 72B of conductive rotor segment 72 and the electrodes 66. It is possible for the conductive segment 72 to be capacitively coupled to the pick-up coil winding 46 such that when the secondary winding of the ignition coil discharges energy into the spark plugs, a high frequency voltage can be capacitively coupled to the pick-up coil 46 with the result that a spurious voltage may be developed in the pick-up coil 46 which is not desirable. In order to prevent spurious voltages from being developed in the pick-up coil 46, the electrostatic shield 50 is provided. The shield 50 provides a ground plane and is electrically connected to the base of the distributor via the metallic bearing 18. When the distributor is assembled to the engine, the base 10 is, of course, electrically grounded to the engine. The plate 50 therefore operates to capacitively couple the rotor segment 72 to ground since, in effect, the plate now operates as one plate of a capacitor so that high frequency voltages are shunted to ground rather than causing spurious voltages to be developed in the pick-up coil 46.

As previously mentioned, the primary function of the plate 50 is to provide an electrostatic shield for the ignition distributor. A secondary function of the plate 50 is to provide a flux shunt for the voltage generating device of the ignition distributor that shunts flux away from pick-up coil 46. Thus, the flux emanating from the outer tip portions 24A of the permanent magnets 24 can pass to the plate 50 which now conducts flux to the opposite ends 24B of the permanent magnets 24 via a magnetic circuit that includes the sleeve bearing 18, the steel distributor shaft 14, and the hub member 22. As long as the tips 24A are not aligned with any of the slots 54 or 56, the plate 50 provides maximum flux shunting. The flux shunting effect is reduced whenever a tip 24A reaches the region of a slot 54 or 56 since the slots now reduce the flux shunting effect because a tip 24A is positioned over the inner ends of the slots 54 and 56 which provide an air gap to the flux shunting effect. The use of the flux shunting plate 50 causes a somewhat higher voltage to be induced in pick-up coil 46 as compared to a device that has no flux shunting plate. This is due to the fact that a greater change in flux is achieved as the rotor pole teeth comprised of permanent magnets 24 rotate past the slots 54 and 56. Since the slot 56 is not as wide as slots 54, and since it is possible for an edge of slot 56 to engage a pole tooth 34, the change in flux shunting effect is reduced over the area of slot 56. However, the other three pole teeth 34 are spaced from the larger slots 54 so that a sharp transition in the flux shunting effect occurs at the three slots 54.

The voltage generator of the distributor of this invention is arranged to provide a simplified assembly of the parts that form the voltage generator. Thus, in assembling the various parts to the base assembly 10, the pole piece 28 is simply slipped over the top end of the sleeve bearing 18 and is rotatably positioned such that the bosses 38 are located adjacent to the sidewalls 12B and 12C. The opening 36 in the pole piece 28 is now aligned with the bore 12D of the base, and the coil winding assembly 40 is now slipped over the axially extending tubular portion 32 of the pole piece 28, and the post 48 is simultaneously projected through opening 36 and into the bore 12D of the base. The plate 50 is now slipped over the sleeve bearing 18, and the snap ring 58 is attached to the grooved portion 59 of the sleeve bearing 18 and into engagement with one end of the plate 50. The entire fixed portion of the voltage generator is now in place and the parts thereof are fixed from axial separation by the snap ring 58. The pole piece 28 is fixed from rotation relative to the base 10 by virtue of the fact that the post 48 projects through the opening 36 in the pole piece 28. The coil winding assembly 40 is fixed from rotation relative to the base 10 by virtue of the fact that the post 48 is positioned within the bore 12D of the base. The inner edges of the slots 54 are maintained in a predetermined air gap relationship with the pole teeth 34. This is due to the fact that the inner wall of the central opening 52 of the plate 50 engages the upper end of the sleeve bearing 18 to provide proper radial orientation for the plate 50. Proper angular position or rotative position of the plate 50 is assured since the width of the slot 56 is substantially the same as the width of a pole tooth 34. Thus, the plate 50 can only rotate to the extent of the clearance between the slot 56 and a pole tooth 34.

The base plate 16 carries an electronic ignition module designated by reference numeral 74.

The ignition distributor that has been described is for a 4-cylinder engine and can be modified for a 6- or 8-cylinder engine For a 6-cylinder engine the rotor 20 would have six equally spaced permanent magnets 24 and six equally spaced pole teeth 34. The cap 60 would have one electrode 64 and six electrodes 66. For an 8-cylinder engine, the rotor 20 would have eight equally spaced permanent magnets 24 and four equally spaced pole teeth 34. The cap 60 would have one electrode 64 and eight electrodes 66.

The ignition distributor that has been described does not have a centrifugal advance mechanism or a vacuum advance unit. This invention could be used with these devices. Thus, a centrifugal advance mechanism could be provided to adjust rotor 20 relative to shaft 14, and the distributor could be arranged so that the pole piece 28 would be rotatably adjusted by a vacuum unit.

As previously mentioned, the dimension of the air gaps between tips 24A of permanent magnets 24 and the pole teeth 34 need not be maintained at such a close tolerance as compared to the devices disclosed in the above-referenced patents. This is believed to be due to the fact that the pole teeth of the rotor 20 are the permanent magnets 24 and have a permeability which is the same as air. In contrast, the pole teeth of the rotors of the above-referenced patents are formed of magnetic material that has a relatively high permeability. Where the pole teeth of the rotor are permanent magnets, it is believed that less flux fringing occurs making it possible to tolerate wider air gaps between the tips 24A and teeth 34 as compared to rotor pole teeth formed of relative high permeability magnetic material.

The distributor cap 60 is secured to base plate 16 by a plurality of screws which have not been illustrated.

The embodiments of the invention for which an exclusive property or privilege is claimed are defined as follows

1. A pulse generator for generating a voltage, the amplitude of which is a function of the rotary position of a rotatable shaft comprising, a shaft, means for rotatably supporting said shaft, a pole piece formed of magnetic material having a plurality of circumferentially spaced axially extending pole teeth, a rotor rotatable with said shaft disposed within said pole teeth comprising a hub member formed of magnetic material carrying a plurality of circumferentially spaced radially extending permanent magnets, each permanent magnet being radially magnetized and arranged such that the outer tip portions thereof have the same magnetic polarity, and the inner end faces thereof carried by said hub member have an opposite magnetic polarity, the circumferential spacing of said permanent magnets and pole piece teeth being such that a plurality of permanent magnets are aligned with a plurality of pole teeth at predetermined angular positions of said rotor, an annular pick-up coil disposed within said pole teeth, and a magnetic circuit coupled to opposite ends of said permanent magnets providing a path for flux linking said pick-up coil comprising said hub member.

2. An ignition control device for controlling an internal combustion engine ignition system comprising, a base member, a shaft adapted to be driven by said engine rotatably supported by said base member, a pole piece formed of magnetic material supported by said base member having a portion disposed about said shaft and having a plurality of circumferentially spaced axially extending pole teeth located radially outwardly of said shaft, an annular pick-up coil disposed about said shaft and within said pole teeth, and a rotor driven by said shaft located adjacent one end of said pick-up coil, said rotor comprising an inner hub member formed of magnetic material that supports a plurality of circumferentially spaced radially outwardly extending permanent magnets, each of said permanent magnets being radially magnetized such that the outer tip portions thereof are of the same magnetic polarity and the inner end faces thereof carried by said hub member have an opposite magnetic polarity, the circumferential spacing of said permanent magnets and pole piece teeth being such that a plurality of said tip portions are aligned with a plurality of pole teeth at a plurality of angular positions of said rotor, the tip portions of said permanent magnets being radially spaced from said pole teeth when said tip portions and pole teeth are aligned to provide an air gap therebetween.

3. An ignition distributor for an internal combustion engine comprising, a base member, a shaft adapted to be driven by said engine rotatably supported by said base member, a distributor cap supported by said base member having an input terminal adapted to be connected to the secondary winding of an ignition coil and a plurality of output terminals adapted to be connected respectively to the spark plugs of said engine, a first rotor driven by said shaft including means for electrically connecting said input terminal and said output terminals as said first rotor rotates, a pole piece formed of magnetic material supported by said base member having a portion disposed about said shaft and having a plurality of circumferentially spaced axially extending pole teeth located radially outwardly of said shaft, an annular pick-up coil disposed about said shaft and within said pole teeth, a second rotor driven by said shaft located adjacent one end of said pick-up coil, said second rotor comprising an inner hub member formed of magnetic material that supports a plurality of circumferentially spaced radially outwardly extending permanent magnets, each of said permanent magnets being radially magnetized such that the outer tip portions thereof are of the same magnetic polarity and the inner end faces thereof carried by said hub member have an opposite magnetic polarity, the circumferential spacing of said permanent magnets and pole piece teeth being such that a plurality of said tip portions are aligned with a plurality of pole teeth at a plurality of angular positions of said second rotor, the tip portions of said permanent magnets being radially spaced from said pole teeth when said tip portions and pole teeth are aligned to provide an air gap therebetween, and a combined electrostatic shield and flux shunt comprising a plate member formed of magnetic metallic material electrically connected to said vase member extending laterally across one end of said pick-up coil and one end of said second rotor, said plate member being disposed between said first rotor and said pick-up coil and being so constructed and arranged as to shunt flux developed by said permanent magnets away from said pick-up coil over certain arcs of rotation of said second rotor.

4. An ignition distributor for an internal combustion engine comprising, a base member, a shaft adapted to be driven by said engine rotatably supported by said base member, a distributor cap supported by said base member having an input terminal adapted to be connected to the secondary winding of an ignition coil and a plurality of output terminals adapted to be connected respectively to the spark plugs of said engine, a first rotor driven by said shaft including means for electrically connecting said input terminal and said output terminals as said first rotor rotates, a pole piece formed of magnetic material supported by said base member having a portion disposed about said shaft and having a plurality of circumferentially spaced axially extending pole teeth located radially outwardly of said shaft, an annular pick-up coil disposed about said shaft and within said pole teeth, and a second rotor driven by said shaft located adjacent one end of said pick-up coil, said second rotor comprising an inner hub member formed of magnetic material that supports a plurality of circumferentially spaced radially outwardly extending permanent magnets, each of said permanent magnets being radially magnetized such that the outer tip portions thereof are of the same magnetic polarity and the inner end faces thereof carried by said hub member have an opposite polarity, the circumferential spacing of said permanent magnets and pole piece teeth being such that a plurality of said tip portions are aligned with a plurality of pole teeth at a plurality of angular positions of said second rotor, the tip portions of said permanent magnets being radially spaced from said pole teeth when said tip portions and pole teeth are aligned to provide an air gap therebetween, and a combined electrostatic shield and flux shunt comprising a plate formed of magnetic metallic material electrically connected to said base member extending laterally across one end of said pick-up coil and one end of said second rotor, said plate having radially extending slots receiving portions of the pole teeth of said pole piece, said plate disposed between said first rotor and said pick-up coil.

5. A voltage generating device for generating a voltage, the amplitude of which is a function of the rotary position of a rotatable shaft comprising, a shaft, means for rotatably supporting said shaft, a pole piece formed of magnetic material having a portion disposed about said shaft and having a plurality of circumferentially spaced axially extending pole teeth located radially outwardly of said shaft, an annular pick-up coil disposed about said shaft and within said pole teeth, a rotor driven by said shaft located adjacent one end of said pick-up coil, said rotor comprising an inner hub member formed of magnetic material that supports a plurality of circumferentially spaced radially outwardly extending permanent magnets, each of said permanent magnets being radially magnetized such that the outer tip portions thereof are of the same magnetic polarity and the inner end faces thereof carried by said hub member have an opposite magnetic polarity, the circumferential spacing of said permanent magnets and pole piece teeth being such that a plurality of said tip portions are aligned with a plurality of pole teeth at a plurality of angular positions of said rotor, the tip portions of said permanent magnets being radially spaced from said pole teeth when said tip portions and pole teeth are aligned to provide an air gap therebetween, and a flux shunt comprising a plate formed of magnetic metallic material extending laterally across one end of said pick-up coil and rotor operative to shunt flux developed by said permanent magnets away from said pick-up coil, said plate having openings receiving at least portions of the pole teeth of said pole piece, at least some of said openings being sized to provide an air gap that reduces the shunting effect of said plate when a tip of a permanent magnet is located in substantial alignment with an opening.

6. A voltage generating device for generating a voltage, the amplitude of which is a function of the rotary position of a rotatable shaft comprising, a shaft, means for rotatably supporting said shaft, a pole piece formed of magnetic material having a portion disposed about said shaft and having a plurality of circumferentially spaced axially extending pole teeth located radially outwardly of said shaft, an annular pick-up coil disposed about said shaft and within said pole teeth, a rotor driven by said shaft located adjacent one end of said pick-up coil, said rotor comprising an inner hub member formed of magnetic material that supports a plurality of circumferentially spaced radially outwardly extending permanent magnets, each of said permanent magnets being radially magnetized such that the outer tip portions thereof are of the same magnetic polarity and the inner end faces thereof carried by said hub member have an opposite magnetic polarity, the circumferential spacing of said permanent magnets and pole piece teeth being such that a plurality of said tip portions are aligned with a plurality of pole teeth at a plurality of angular positions of said rotor, the tip portions of said permanent magnets being spaced from said pole teeth when said tip portions and pole teeth are aligned to provide an air gap therebetween, and a combined electrostatic shield and flux shunt comprising a plate formed of magnetic metallic material extending laterally across one end of said pick-up coil and rotor and located therebetween operative to shunt flux developed by said permanent magnets away from said pick-up coil, said plate having openings receiving at least portions of the pole teeth of said pole piece, at least some of said openings being sized to provide an air gap that reduces the shunting effect of said plate when a tip of a permanent magnet is located in substantial alignment with an opening.

7. An ignition control device for controlling an internal combustion engine ignition system comprising, a base having a bore, a sleeve bearing disposed within said bore, a shaft rotatably supported by said bearing, a pole piece formed of magnetic material having an inner annular portion engaging an outer wall of said bearing, a laterally extending portion engaging said base and a plurality of circumferentially spaced axially extending pole teeth, an annular pick-up coil assembly comprising a coil form carrying a coil winding, said coil form disposed about said bearing and engaging said laterally extending portion of said pole piece, said coil form having an axially extending post extending through an opening formed in said laterally extending portion of said pole piece and disposed within a bore formed in said base, means engaging said bearing for preventing axial displacement of said coil assembly and pole piece and a rotor carrying at least one permanent magnet rotatably driven by said shaft and cooperating with said pole teeth to cause a voltage to be induced in said coil winding when said shaft and rotor rotate.

8. A rotor assembly for a permanent magnet voltage generator comprising, a shaft, a hub member formed of magnetic material fixed to said shaft having a plurality of circumferentially spaced radially extending slots, each slot being wedge shaped and each slot having an open end located adjacent the periphery of the hub member, and a plurality of wedge shaped permanent magnets, a radially extending portion of each permanent magnet being located in a respective wedge shaped slot, each permanent magnet having an outer end portion extending radially outwardly beyond the edge of said hub member defining a rotor pole tooth, each permanent magnet being radially magnetized such that the outer end portions thereof all have the same magnetic polarity and the inner end faces thereof located in said slots have an opposite magnetic polarity.

* * * * *